US008234720B2

(12) United States Patent
Freedman et al.

(10) Patent No.: US 8,234,720 B2
(45) Date of Patent: Aug. 7, 2012

(54) SWEATSHIRT

(76) Inventors: Seth Freedman, Sherman Oaks, CA (US); Lindsey Demayo, Sherman Oaks, CA (US)

( * ) Notice: Subject to any disclaimer, the term of this patent is extended or adjusted under 35 U.S.C. 154(b) by 483 days.

(21) Appl. No.: 12/268,791

(22) Filed: Nov. 11, 2008

(65) Prior Publication Data

US 2010/0115684 A1 May 13, 2010

(51) Int. Cl.
*A41D 27/20* (2006.01)
*A41D 1/02* (2006.01)

(52) U.S. Cl. ..... 2/128; 2/96; 2/108; 2/251; 2/253

(58) Field of Classification Search ..... 2/247, 253, 2/251, 96, 94, 91, 108, 88, 85, 93, 51, 90, 2/115, 84, 79, 72, 86, 89, 95, 103, 128, 69, 2/69.5, 243.1
See application file for complete search history.

(56) References Cited

U.S. PATENT DOCUMENTS 2,324,722 A * 7/1943 Papierniak ..... 2/93
2,422,779 A * 6/1947 Fligel ..... 2/93
3,077,604 A * 2/1963 Colangelo ..... 2/93
4,507,805 A * 4/1985 Calutoiu ..... 2/69.5
4,651,348 A * 3/1987 Swanson ..... 2/93
4,773,102 A * 9/1988 Curtis et al. ..... 2/93
4,882,786 A * 11/1989 Gross ..... 2/94
5,195,187 A * 3/1993 Yang ..... 2/102
D366,131 S * 1/1996 Smith et al. ..... D2/622
6,119,269 A * 9/2000 Imler et al. ..... 2/94
6,868,558 B2 * 3/2005 Majerfeld ..... 2/96
7,028,341 B2 * 4/2006 Ikenaga et al. ..... 2/102
D551,429 S * 9/2007 Wager ..... D2/831
2002/0040493 A1 * 4/2002 Wooley et al. ..... 2/102
2002/0142112 A1 * 10/2002 Tarrell ..... 428/17
2005/0102729 A1 * 5/2005 Snedeker ..... 2/96
2007/0226871 A1 * 10/2007 Hood ..... 2/69
2009/0055991 A1 * 3/2009 Johnson et al. ..... 2/84
2009/0265829 A1 * 10/2009 Gomes Seguin et al. ..... 2/87
2010/0127025 A1 * 5/2010 Kelling ..... 224/153

* cited by examiner

*Primary Examiner* — Amy Vanatta
(74) *Attorney, Agent, or Firm* — Michael N. Cohen; Cohen IP Law Group, P.C.

(57) ABSTRACT

A sweatshirt is disclosed that has a main body with a front panel and a back panel. The front panel includes an inner surface and an outer surface. The back panel also includes an inner surface and an outer surface. A pair of pockets having a pair of opposing edges is positioned on a lower edge of the front panel proximate the opening. At least one closure means is positioned in the front panel. The closure means includes a bottom zipper and a second zipper. The bottom zipper includes a first row teeth and a second row teeth extending along the pair of opposing edges in the front panel. The second zipper includes a first row teeth and a second row teeth extending along the opposing edges of the pair of pockets, each being proximate the bottom zipper.

2 Claims, 4 Drawing Sheets

SWEATSHIRT

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to pocketed sweatshirts, and more particularly to a method of defining pockets in different configurations.

DISCUSSION OF RELATED ART

Sweatshirts are very popular type of clothing that are worn by millions of people across the world, coming in a wide variety of colors, sizes and with many different images on the shirt. Some of the various styles of sweatshirts include hand-warmer pockets positioned on the front of the garment. The reason that sweatshirts are popular particularly in warm weather is that they are light weight, absorb perspiration, protect against drafts after exercise when the body is hot and cooling down. The sweatshirts are easily washable due to its light weight.

U.S. Pat. No. 4,062,064 to Vosatka explains a shirt having a breast pocket that is designed to hold a pair of eyeglasses in a manner so that the eyeglasses cannot fall out accidentally. The pocket is at a rear side of the shirt front panel and is closable by a slide fastener. While the particular invention fulfills their respective objectives, the need remains for a sweatshirt with pockets to keep the hands warm. Another prior art taught in U.S. Pat. No. 5,509,147 to Agustin discloses a multi-pocket system for a garment. It includes a plurality of pockets. While this pocketed garment appears to work satisfactorily for their intended purpose, they provide a sagging appearance of the garment.

U.S. Pat. No. 4,773,102 to Curtis teaches an outer garment to be worn by two persons together consisting of two inner arm support compartments. Access to the inner pocket is complicated since it is not sufficiently sized for the wearer to place their hands within the inner pocket. Furthermore, when the wearer places his hands into the inner pockets, the hands tend to rest at the bottom of the pocket making it difficult for the wearer to keep their shoulders back and maintain good posture.

Therefore there is a need for an improved sweatshirt having a pair of pockets which are specially positioned so as to warm each hand of a wearer. Such a needed sweatshirt would also facilitate a one pocket configuration permitting the wearer keeping both hands together. The present invention accomplishes these objectives.

SUMMARY OF THE INVENTION

The present invention is a sweatshirt comprising a main body having a front panel and a back panel. The front panel includes an inner surface and an outer surface. The front panel further includes a longitudinal opening forming a pair of opposing edges. The back panel also includes an inner surface and an outer surface. A pair of pockets having a pair of opposing edges is positioned on a lower edge of the front panel proximate the opening. At least one closure means is positioned in the front panel.

The closure means includes a bottom zipper and a second zipper. The bottom zipper includes a first row teeth and a second row teeth extending along the pair of opposing edges in the front panel. The second zipper includes a first row teeth and a second row teeth extending along the opposing edges of the pair of pockets, each being proximate the bottom zipper.

The present invention is an improved sweatshirt having a pair of pockets which are specially positioned so as to warm each hand of a wearer. Such a sweatshirt also facilitates a one pocket configuration permitting the wearer keeping both hands together. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
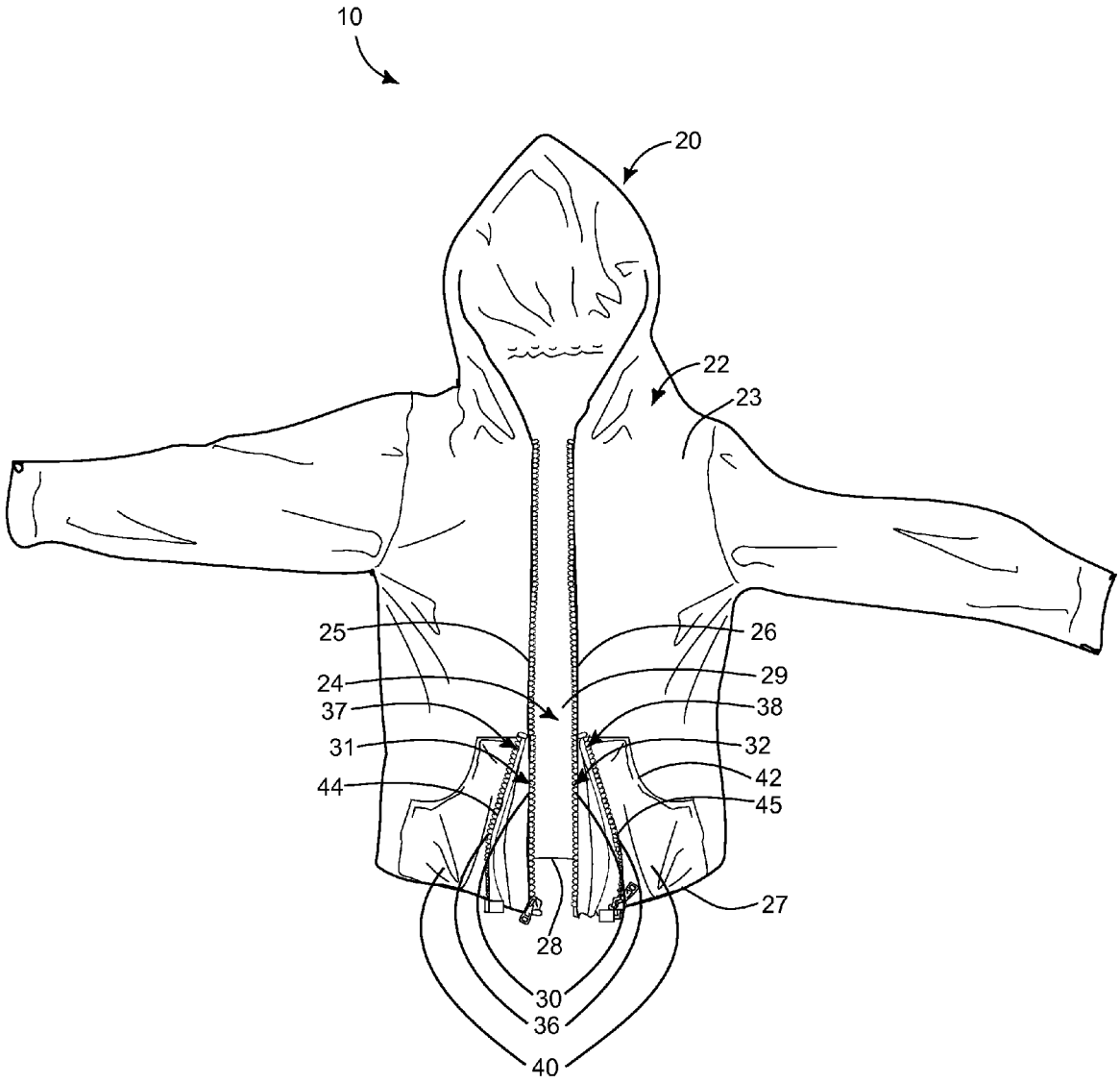
FIG. 1 is a front elevational view of an invention, illustrating an opened bottom zipper and an opened second zipper.

FIGS. 1, 2, 3 and 4 illustrate a sweatshirt 10 comprising a main body 20 having a front panel 22 and a back panel 28. The front panel 22 includes an inner surface (not shown) and an outer surface 23. The front panel 22 further includes a longitudinal opening 24 forming a pair of opposing edges 25 and 26. The back panel 28 also includes an inner surface 29 and an outer surface (not shown). A pair of pockets 40 having a pair of opposing edges 44 and 45 is positioned on a lower edge 27 of the front panel 22 proximate the longitudinal opening 24. At least one closure means 50 (FIG. 4) is positioned in the front panel 22. The pair of pockets 40 includes a plurality of slits 42 that may be adapted to receive at least one hand (not shown) for keeping warmth.

Figure 4:
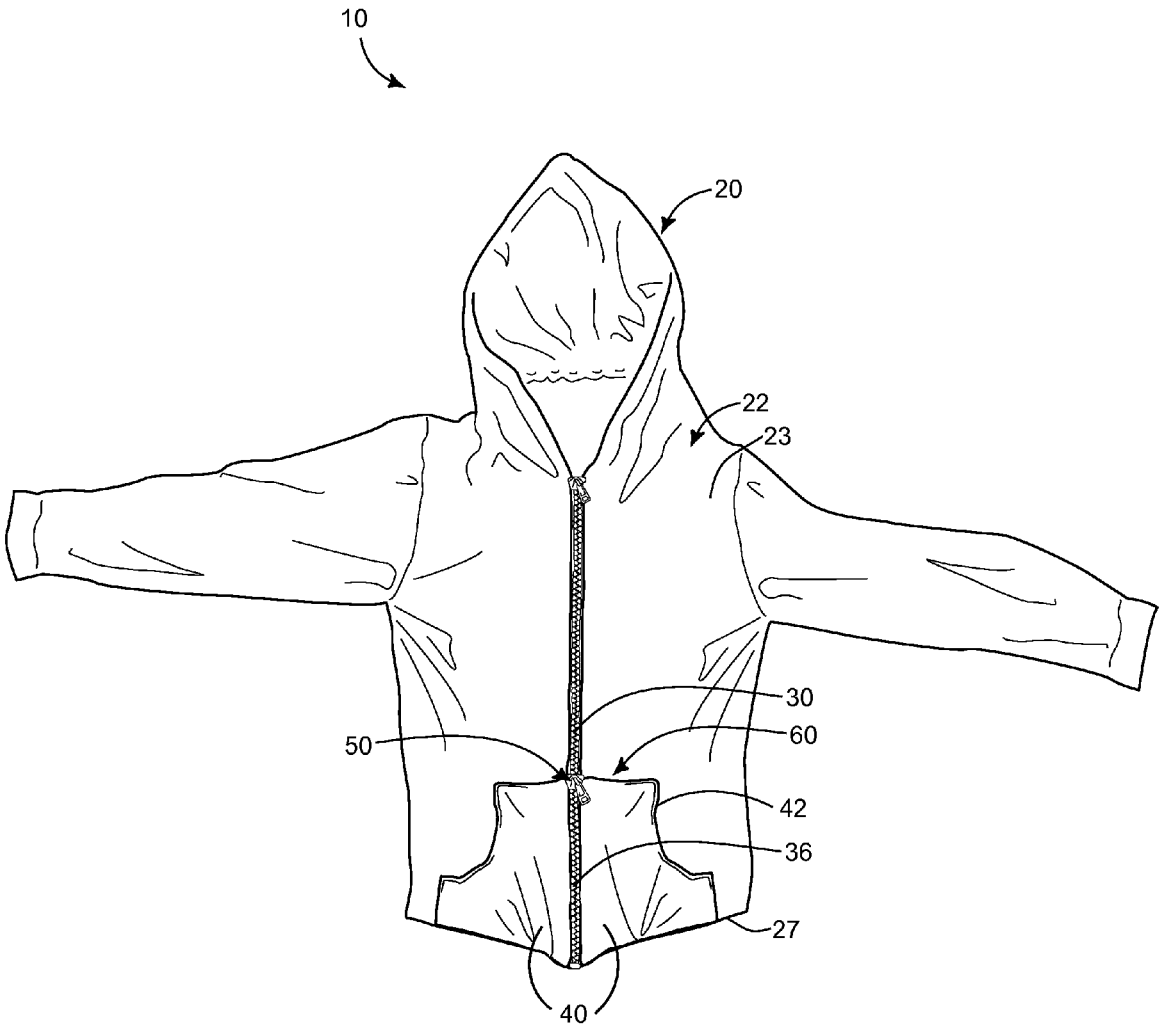
FIG. 4 is a front elevational view of the invention, illustrating a single pocket.

The closure means 50 includes a bottom zipper 30 and a second zipper 36 (FIG. 4). The bottom zipper 30 includes a first row teeth 31 and a second row teeth 32 extending along the pair of opposing edges 25 and 26 in the front panel 22. The second zipper 36 includes a first row teeth 37 and a second row teeth 38 extending along the opposing edges 44 and 45 of the pair of pockets 40, each being proximate the bottom zipper 30.

Figure 2:
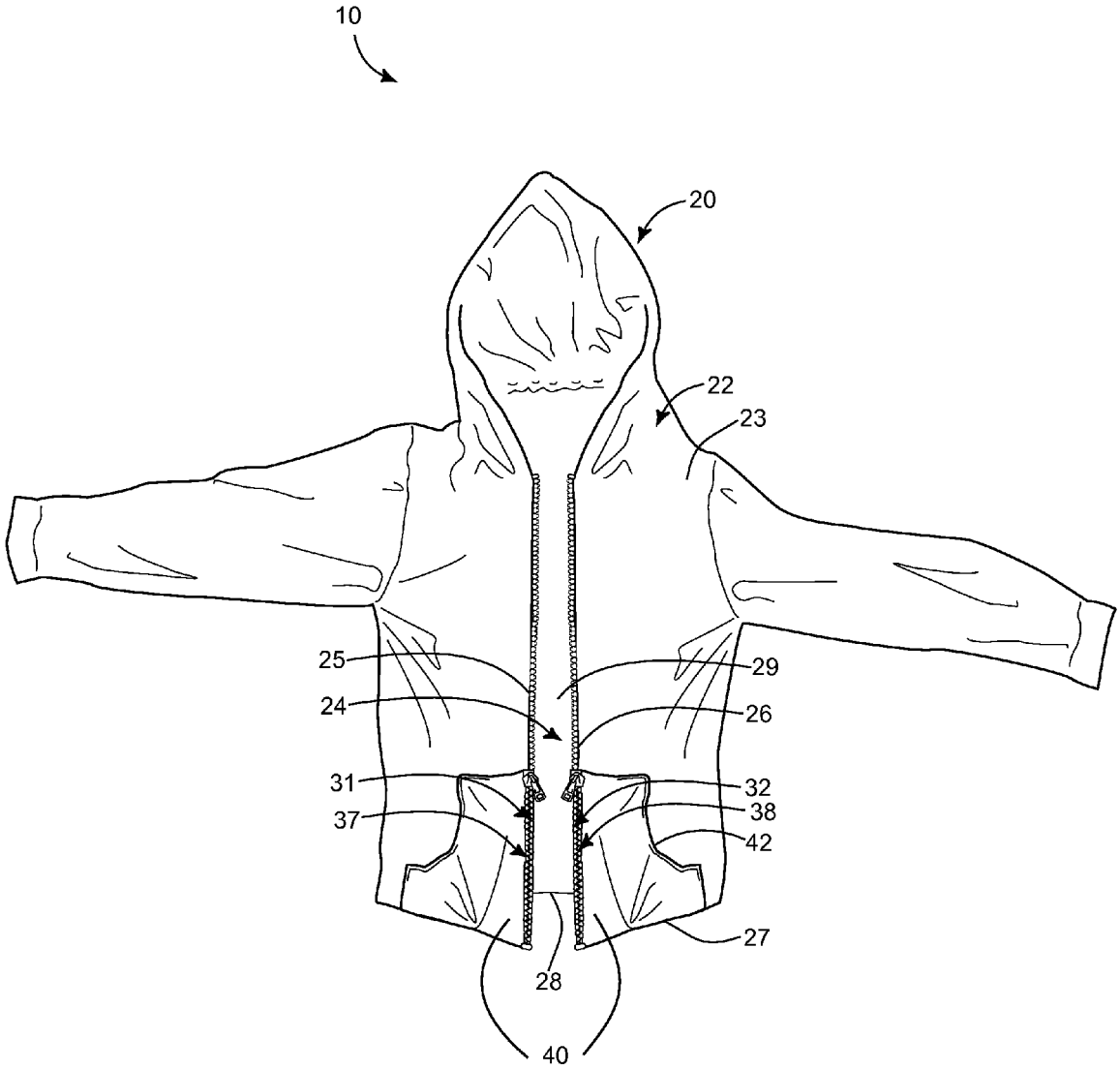
FIG. 2 is a front elevational view of the invention, illustrating a pair of pockets.
Figure 3:
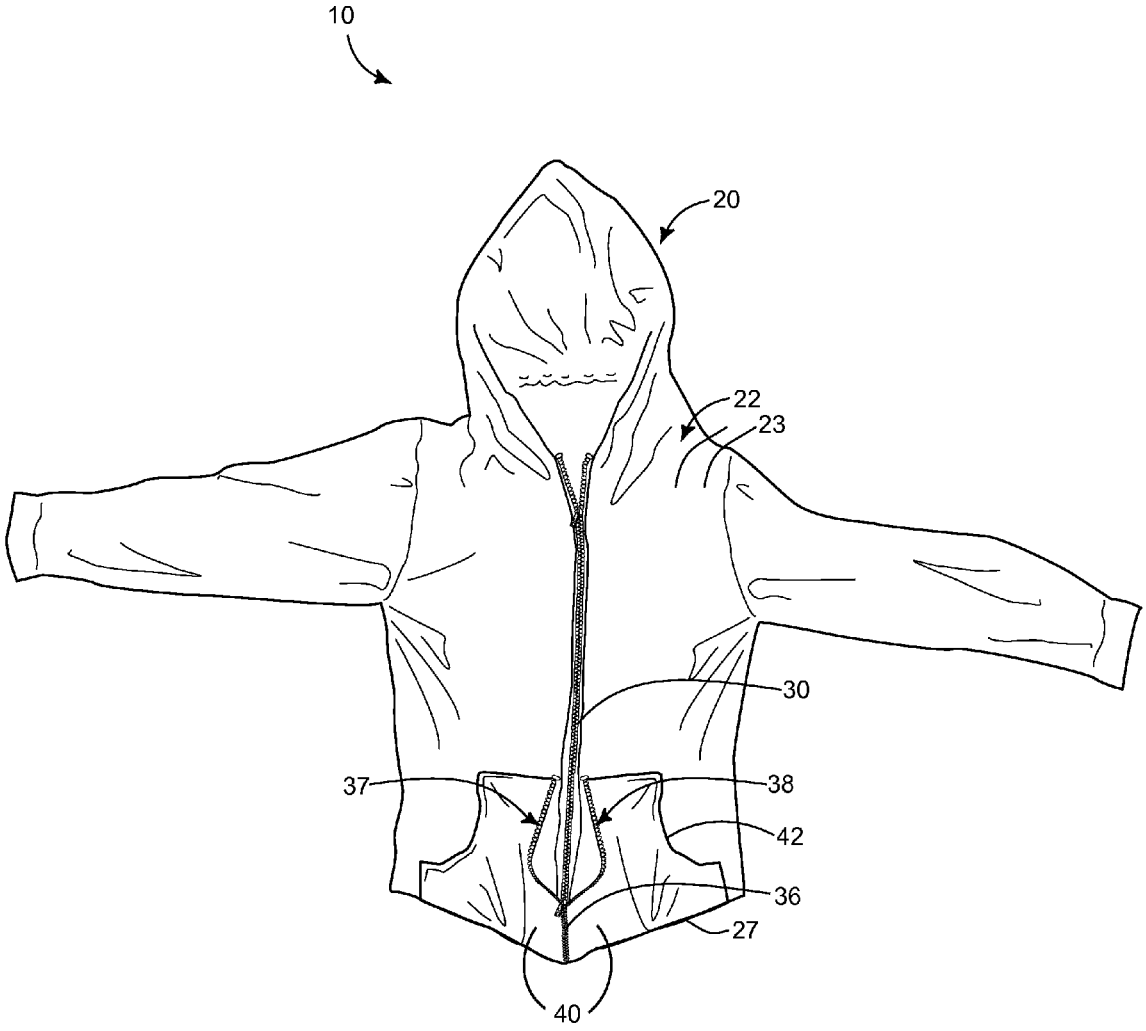
FIG. 3 is a front elevational view of the invention, illustrating the bottom zipper completely closed and the second zipper partially closed.

The pair of pockets 40 is defined by zipping the first row teeth 31 of the bottom zipper 30 with the first row teeth 37 of the second zipper 36 and the second row teeth 32 of the bottom zipper 30 with the second row teeth 38 of the second zipper 36 (FIG. 2). The first row teeth 31 of the bottom zipper 30 is zipped with the second row teeth 32 of the bottom zipper 30 and the first row teeth 37 of the second zipper 36 with the second row teeth 38 of the second zipper 36 thereby defining a single pocket 60 (FIG. 4).

While a particular form of the invention has been illustrated and described, it will be apparent that various modifications can be made without departing from the spirit and scope of the invention. For example, main body 20 may be made by variations in size, materials, shape, form, manner of operation, assembly and method of use. Accordingly, it is not intended that the invention be limited, except as by the appended claims.

What is claimed is:

1. A sweatshirt comprising:

a main body having a front panel and a back panel, each panel having an inner surface and an outer surface thereof, the front panel having a longitudinal opening thereof, forming a pair of opposing edges;

a pair of pockets having a pair of opposing edges, each pocket being positioned on a lower edge of the front panel proximate the longitudinal opening; and at least one closure means positioned in the front panel including a bottom zipper and a second zipper;

wherein the bottom zipper includes a first row teeth and a second row teeth extended along the pair of opposing edges in the front panel, and the second zipper includes a first row teeth and a second row teeth extended along the pair of opposing edges of the pair of pockets, each being proximate the bottom zipper; wherein the first row teeth of the bottom zipper is zipped with the first row teeth of the second zipper and the second row teeth of the bottom zipper is zipped with the second row teeth of the second zipper thereby keeping the pair of pockets in a closed position;

whereby the pair of pockets includes a plurality of slits that may be adapted to receive at least one hand for keeping warm.

2. The sweatshirt of claim 1 wherein the first row teeth of the bottom zipper is zipped with the second row teeth of the bottom zipper and the first row teeth of the second zipper is zipped with the second row teeth of the second zipper thereby forming a single pocket.

* * * * *